US007434644B2

(12) United States Patent
Wier

(10) Patent No.: US 7,434,644 B2
(45) Date of Patent: Oct. 14, 2008

(54) POWERED SNOWBOARD

(76) Inventor: Kenneth L. Wier, 2501 Cedar St., Rolling Meadows, IL (US) 60008

( * ) Notice: Subject to any disclaimer, the term of this patent is extended or adjusted under 35 U.S.C. 154(b) by 157 days.

(21) Appl. No.: 11/365,427

(22) Filed: Mar. 1, 2006

(65) Prior Publication Data

US 2007/0205034 A1 Sep. 6, 2007

(51) Int. Cl.
*B62M 27/02* (2006.01)

(52) U.S. Cl. ..... 180/180; 180/9.22; 180/19.1; 180/9.1; 180/172; 180/56

(58) Field of Classification Search ..... 180/180, 180/9.22, 19.1, 9.1, 172, 56
See application file for complete search history.

(56) References Cited

U.S. PATENT DOCUMENTS

| | | | | |
|---|---|---|---|---|
| 2,625,229 | A | 1/1953 | VanVoorhees | |
| 3,645,348 | A | 2/1972 | Thompson | |
| 3,710,881 | A | 1/1973 | Thompson | |
| 3,742,928 | A | 7/1973 | Albertson | |
| 3,853,192 | A * | 12/1974 | Husted | 180/181 |
| 4,069,881 | A | 1/1978 | Shiber | |
| 4,183,546 | A | 1/1980 | Heilig | |
| 4,307,788 | A | 12/1981 | Shelton | |
| 5,127,488 | A | 7/1992 | Shanahan | |
| D346,419 | S | 4/1994 | Carpenter et al. | |
| 5,416,952 | A | 5/1995 | Dodge | |
| 5,487,441 | A | 1/1996 | Endo et al. | |
| 5,568,840 | A * | 10/1996 | Nagata et al. | 180/190 |
| 5,662,186 | A | 9/1997 | Welch | |
| 5,820,155 | A | 10/1998 | Brisco | |
| 5,909,894 | A | 6/1999 | Meader et al. | |
| 5,927,420 | A | 7/1999 | Karrington | |
| 5,975,229 | A | 11/1999 | Hosoda | |
| D418,545 | S | 1/2000 | Cassel | |
| 6,056,300 | A | 5/2000 | Carpenter et al. | |
| 6,206,403 | B1 | 3/2001 | Black et al. | |
| 6,253,467 | B1 | 7/2001 | Maravetz et al. | |
| D455,187 | S | 4/2002 | Janisch | |
| 6,435,290 | B1 | 8/2002 | Justus et al. | |
| 6,481,741 | B1 | 11/2002 | Porte | |
| 6,604,746 | B1 | 8/2003 | Sato et al. | |
| 6,679,515 | B2 | 1/2004 | Carrasca | |
| 6,698,540 | B1 | 3/2004 | Decker, Jr. | |
| 6,725,959 | B1 * | 4/2004 | Shea et al. | 180/190 |
| 6,848,527 | B2 | 2/2005 | Nelson | |
| 2004/0144583 | A1 | 7/2004 | Decker, Jr. | |
| 2004/0163868 | A1 | 8/2004 | Decker, Jr. | |

* cited by examiner

*Primary Examiner*—Christopher Ellis
*Assistant Examiner*—Cynthia F. Collado
(74) *Attorney, Agent, or Firm*—Valauskas & Pine LLC

(57) ABSTRACT

A powered snowboard having a drive assembly mounted thereon, the drive assembly including a frame, a track assembly having a track suspended over multiple wheels, the track assembly being supported in the frame such that it is able to travel in a vertical direction as well as pivot about an axis, and a motor operatively engaged with the track such that it drives the track thus propelling the snowboard. A cutout is formed in the snowboard through which the track assembly engages the snow or ice below the snowboard, and the track assembly is biased against the snow or ice to maintain a constant contact with the snow or ice during use.

15 Claims, 5 Drawing Sheets

POWERED SNOWBOARD

FIELD OF THE INVENTION

The invention relates to power driven recreational devices, and more particularly, snowboards powered by a motor.

SUMMARY OF THE INVENTION

In accordance with the present invention, there is provided a unique device in the form of a power-driven snowboard. The device includes a board similar in size and shape to a conventional snowboard, the board being adapted such that a rider can engage the board and steer the board in a fashion similar to a conventional snowboard. A drive frame is mounted on a rear portion of the board. The drive frame includes a plurality of wheels mounted therein, a ridged drive track for driving the snowboard across snow or ice, and a gas or electric motor to power the drive track. The drive track is suspended in such a way so that it maintains sufficient contact with a ground surface during maneuvering. The rider can control the motor by way of a hand held controller connected to the motor.

DESCRIPTION OF AN EMBODIMENT

Figure 1:
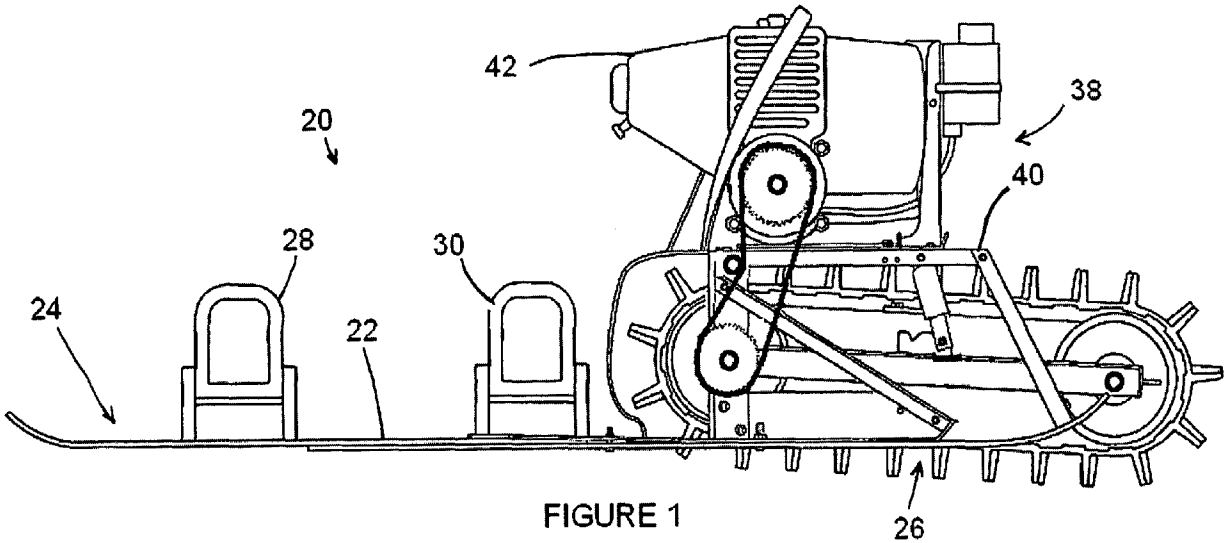
FIG. 1 is side view of an embodiment of the present invention.
Figure 2:
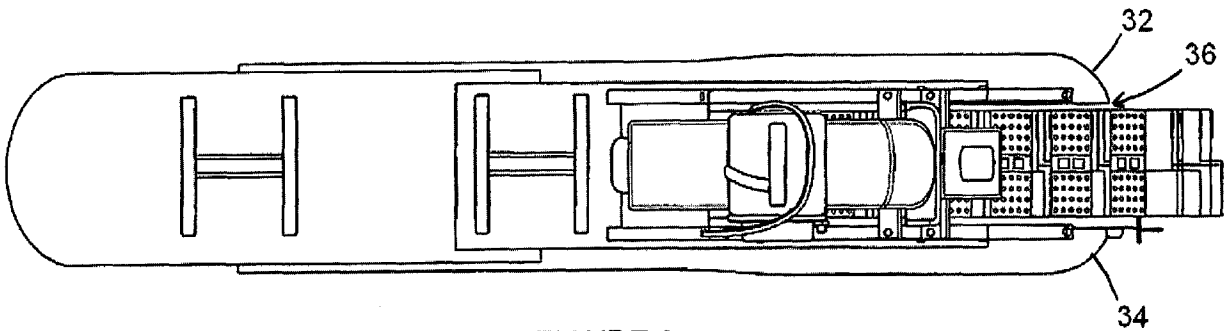
FIG. 2 is a top view of the embodiment of the present invention illustrated in FIG. 1.

Referring to FIGS. 1 and 2, an embodiment of a powered snowboard of the present invention is designated generally by the reference numeral 20. The snowboard 20 includes a base board 22 similar to that of a standard snowboard having a front portion 24 and a rear portion 26. The front portion 24 includes a pair of standard snowboard bindings 28, 30. The rear portion 26 has two prongs 32, 34 defining an opening 36 therebetween.

Figure 4:
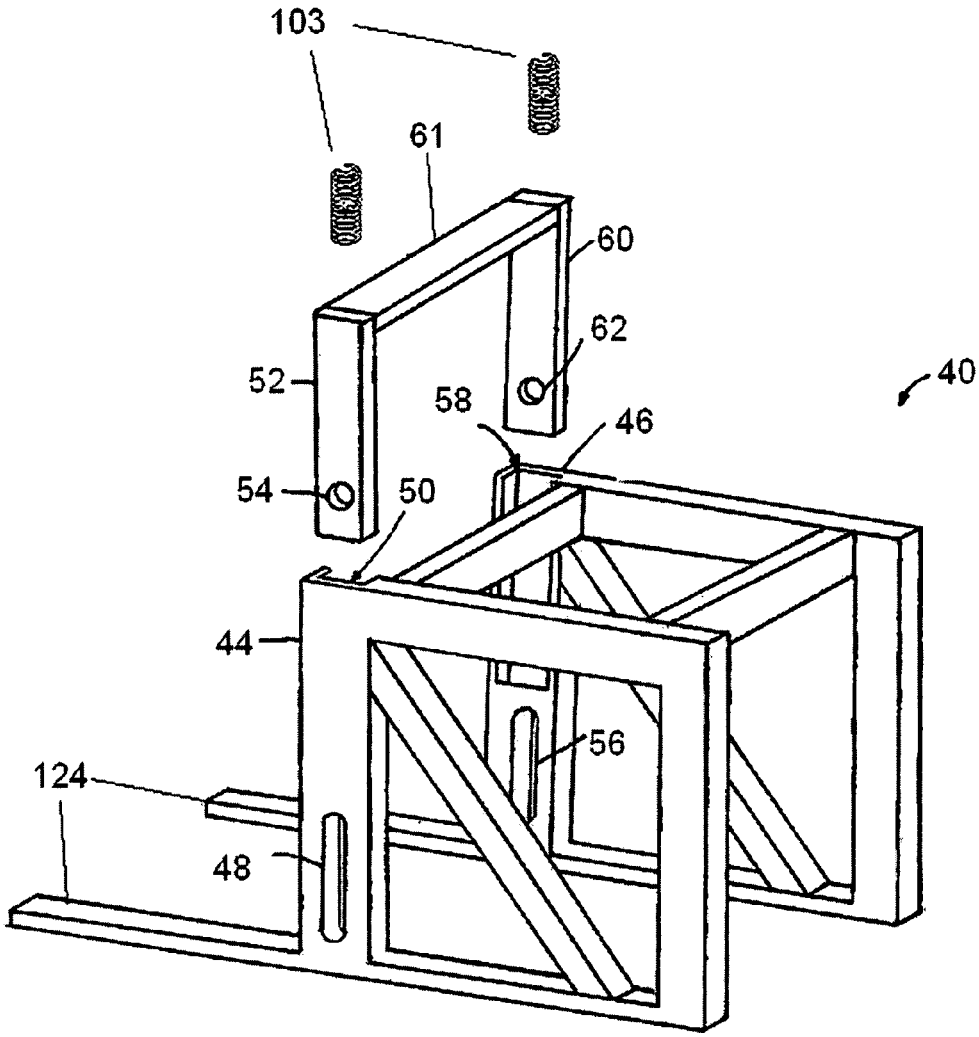
FIG. 4 is a perspective view of an frame of an embodiment of the present invention.
Figure 5:
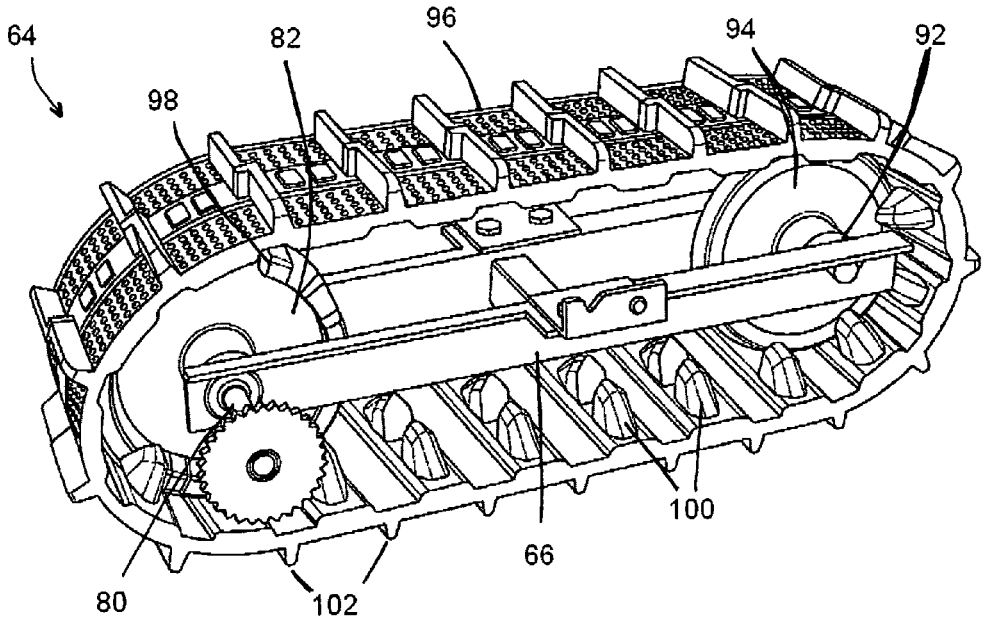
FIG. 5 is a perspective view of a track assembly of an embodiment of the present invention.
Figure 6:
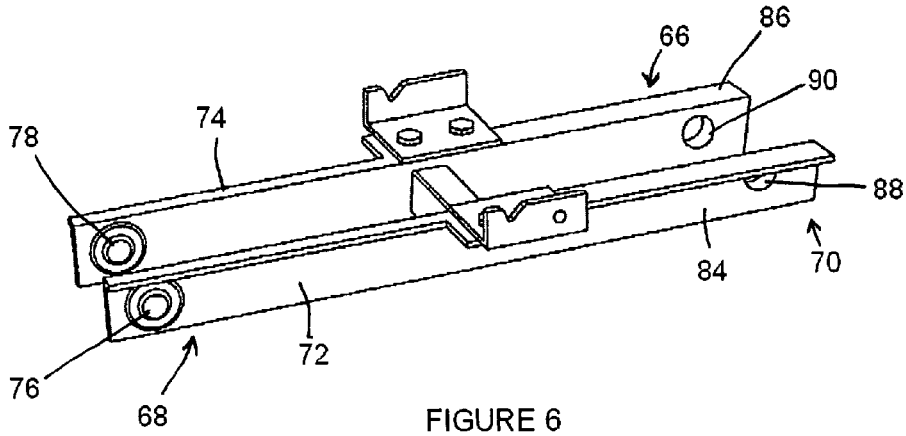
FIG. 6 is a perspective view of a swing frame of an embodiment of the present invention.

A drive assembly 38 is mounted on the rear portion 26 of the base board 22 by any suitable means, such as nuts and bolts. The drive assembly 38 includes a frame 40 that is located over opening 36. A gas or electric powered motor 42 is mounted to frame 40. The frame 40, as shown in more detail in FIG. 4, includes a first leg member 44, and a second leg member 46. The first leg member 44 and second leg member 46 stand upright in relation to the base board 22 on either side of opening 36. The first leg member 44 has an elongated opening 48 therethrough. The elongated opening 48 is in communication with a slider channel 50 inside of first leg member 44. A first slider 52 having an aperture 54 therethrough is received within the slider channel 50. The second leg member 46 has an elongated opening 56 therethrough. The elongated opening 56 is in communication with a slider channel 58 inside of second leg member 46. A second slider 60 having an aperture 62 therethrough is received within slider channel 58. The first slider 52 and the second slider 60 are connected by a connecting member 61, and slide vertically within the slider channels 50 and 58.

The drive assembly 38 also includes a track assembly 64 having a generally "H-shaped" swing frame 66 with a front end 68 and a back end 70. Front end 68 of swing frame 66 is defined by front swing frame arms 72, 74 having apertures 76, 78 therein such that a first axel 80 can pass therethrough. A drive wheel 82 is rotatably mounted on the first axel 80 between front swing frame arms 72, 74. Back end 70 of swing frame 66 is defined by back swing frame arms 84, 86 having apertures 88, 90 therein such that a second axel 92 can pass therethrough. A tension wheel 94 is rotatably mounted on the second axel 92 between back swing frame arms 84, 86. A drive track 96 is suspended over drive wheel 82 and tension wheel 94. Drive wheel 82 has lugs 98 thereon that engage spaced-apart protrusions 100 on the inner surface of the drive track 96. Drive track 96 also has projecting treads 102 on its outer surface that engage the ground surface to drive the powered snowboard 20 forward.

The track assembly 64 is suspended within frame 40 such that the drive track 96 extends through opening 36 in base board 22 to engage the ground surface. First axel 80 is received between first and second leg members 44 and 46. One end of the first axel 80 passes through the elongated opening 48 of the first leg member 44 and the aperture 54 of the first slider 52 that is within the first leg member 44, and the other end of the first axel 80 passes through the elongated opening 56 of the second leg member 46 and the aperture 62 of the second slider 60 that is within the second leg member 46. Thus the track assembly 64 can pivot about the first axel 80, and travel vertically with the first axel 80 within the elongated openings 48 and 56 as the first and second sliders 52 and 60 slide within the slider channels 50 and 58 of the first and second leg members 44 and 46. Springs 103 are provided within the slider channels 50 and 58 that engage the connecting member 61 such that the first and second sliders 52 and 60 are biased downward.

The swing frame 66 is connected to the frame 40 by a shock 104 that forces the swing frame 66 generally downward to keep the drive track 96 in constant engagement with the ground surface. The shock 104 may be a spring shock, a gas shock, or an air shock, or any equivalent thereof. It is also understood that shock 104 can be replaced by any other biasing means, such as a pull spring, so long as the biasing means forces the drive track 96 into engagement with the ground surface.

The drive track 96 is wider than the width of both the drive wheel 82 and the tension wheel 94 such that the drive track 96 may remain in flat engagement with the ground surface when the drive wheel 82 and the tension wheel 94 are angled during steering of the snowboard 20.

Figure 3:
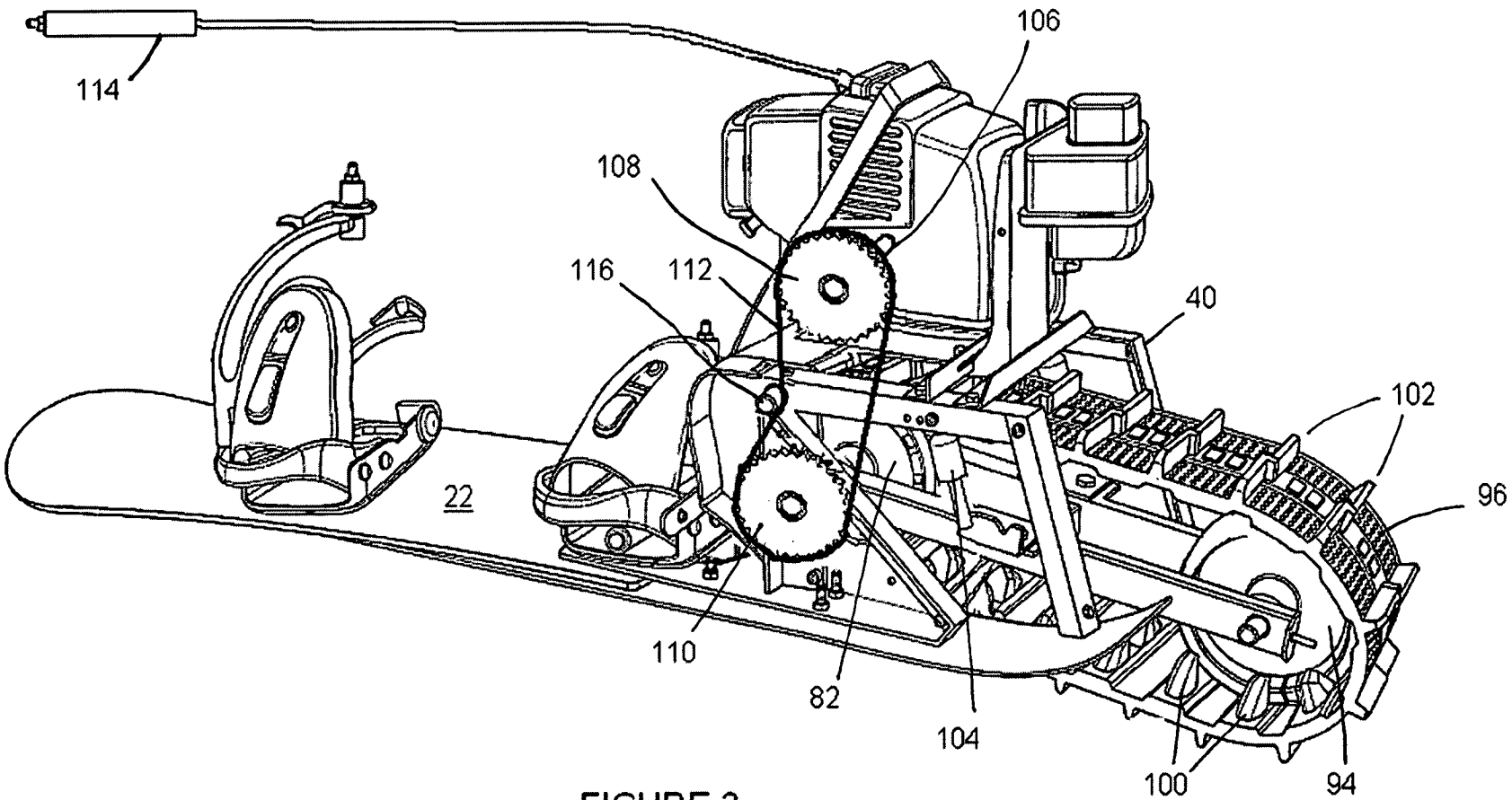
FIG. 3 is a perspective view of an embodiment of the present invention.

The motor 42 has a drive shaft 106 extending outwardly and having a first sprocket 108 secured to the outer end of the drive shaft 106 as best seen in FIG. 3. A second sprocket 110 is secured to the outer end of the first axel 80. The second sprocket is connected to the first sprocket by a drive chain, or drive belt 112 such that when the motor 42 is activated, the drive shaft 106 and the first sprocket are rotated, thereby rotating the second sprocket 112 and the first axel 80, which forces the drive wheel 82 to rotate. As the drive wheel 82 rotates, lugs 98 engage the protrusions 100 on the inner surface of the drive track 96 causing the drive track 96 to revolve and drive the snowboard 20. The motor 42 is controlled by suitable means such as a handheld trigger 114 as illustrated in FIG. 3 with which a rider can increase or decrease the speed of the snowboard 20. Frame 40 also includes a chain tensioner 116 that maintains the proper tension on the drive chain 112 as the second sprocket 110 moves with the first axel 80 as the first axel 80 travels within the elongated openings 48 and 56 of the first and second leg members 44 and 46. In this embodiment, the chain tensioner 116 takes the form of a spindle that is biased against the drive chain 112 to maintain the proper tension.

Figure 7:
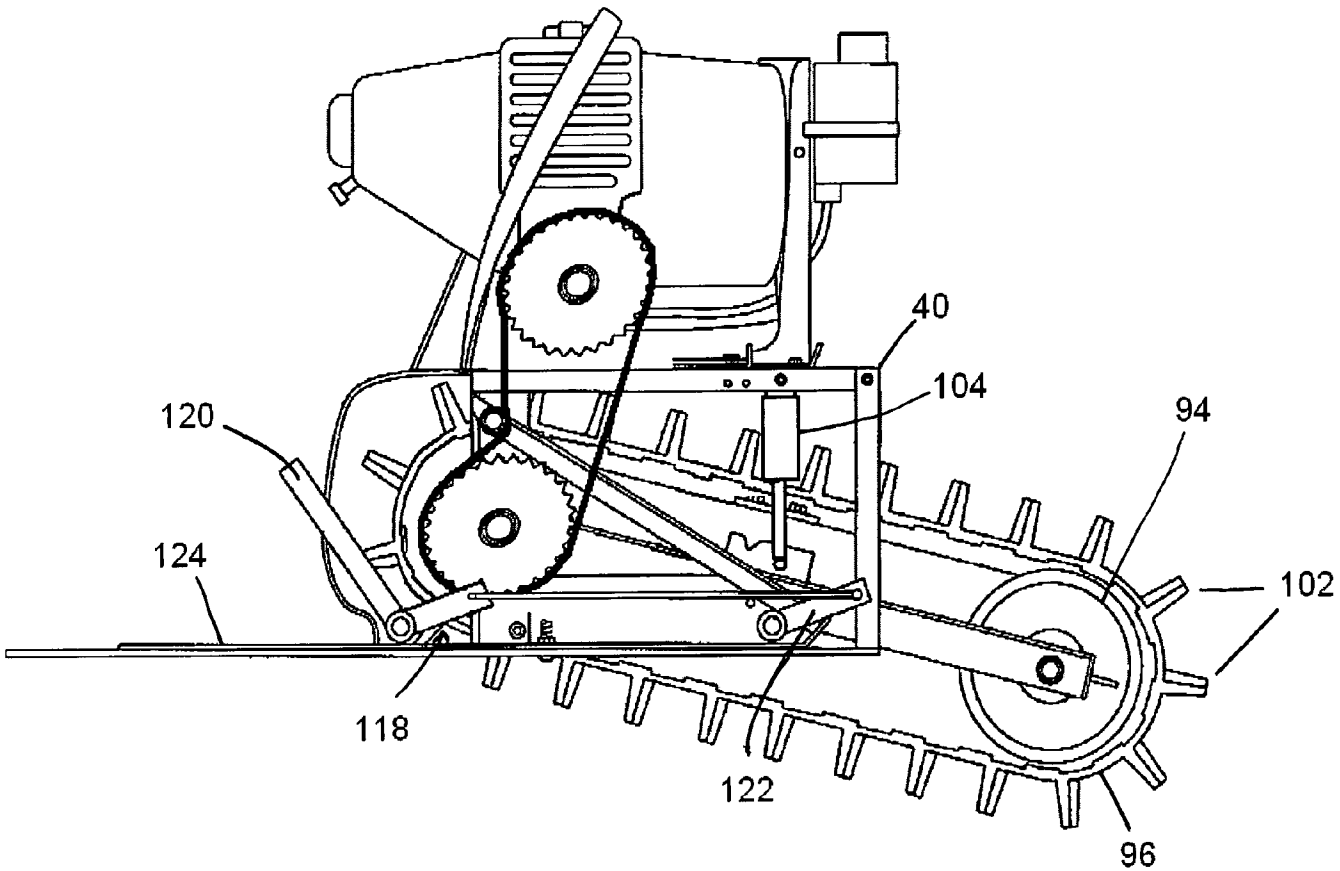
FIG. 7 is a side view of a drive assembly of an embodiment of the present invention.

As illustrated in FIG. 7, the snowboard 20 may also include disengagement means 118 that when used removes the track assembly 64 and particularly the drive track 96 from engagement with the ground surface. In the present embodiment, the disengagement means 118 consists an "L"-shaped disengagement lever 120 and a disengagement arm 122. The disengagement lever 120 and disengagement arm 122 are both pivotably attached to a foot plate 124 of either first leg member 44 or second leg member 46. The disengagement arm 122 is connected to the swing frame 66 by any suitable means such as nuts and bolts, or welding, and is also connected to the disengagement lever 120 by suitable means such as a rod, such that when the disengagement lever 120 is rotated towards the front end 24 of the snowboard 20, it pulls the disengagement arm 122 in the same direction thus lifting the track assembly 64 from engagement with the ground surface. When the disengagement lever 120 is rotated towards the back end 26 of the snowboard 20, it pushes the disengagement arm 122 in the same direction thus lowering the track assembly 64 into engagement with the ground surface.

It should be appreciated that the embodiments described above are to be considered in all respects only illustrative and not restrictive. The scope of the invention is indicated by the following claims rather than by the foregoing description. All changes that come within the meaning and range of equivalents are to be embraced within their scope.

What is claimed is:

1. An apparatus for propelling a passenger across a ground surface, comprising:

a board including a top surface, a bottom surface, a front end and a back end, said top surface being adapted to receive the passenger thereon, and said bottom surface being adapted for sliding engagement on a ground surface;

a frame attached to said board proximate said back end, wherein said frame further includes a first side member, a second side member, an axel frame, and a spring means for biasing said axel frame in a specific direction, said first side member including a first channel therein, said second side member including a second channel therein, said axel frame including a first leg member with a first opening and a second leg member with a second opening, said first leg member being received within said first channel, said second leg member being received within said second channel such that said axel frame moves vertically within said first and second side members, said axel frame being forced in a generally downward direction by said spring means, and said first axel extending through said first and second openings of said first and second leg members of said axel frame; and a drive assembly mounted to said frame, said drive assembly including a first wheel, a second wheel, a motor and a track, said first wheel being spaced apart from said second wheel such that said track is supported by said first wheel and said second wheel, and said drive assembly further includes at least one arm member, a first axel, and a second axel, said at least one arm member including a first end with a first aperture, and a second end with a second aperture, said first axel extending through said first aperture, said first wheel being received on said first axel, said second axel extending through said second aperture, said second wheel being received on said second axel, wherein said at least one arm member is connected to said frame by a biasing means for forcing said at least one arm member in a generally downward direction such that said track engages the ground surface, said motor being operatively engaged with said track such that, in operation, said track drives said board across the ground surface.

2. The apparatus of claim 1, further comprising an opening formed in said back end.

3. The apparatus of claim 1, wherein said frame is attached to said top surface.

4. The apparatus of claim 2, wherein a portion of said track extends through said opening in said back end.

5. The apparatus of claim 1, wherein said biasing member is one or more of a spring member, a coil spring, an air spring, and an elastomeric spring.

6. The apparatus as defined in claim 1, wherein said first wheel and said second wheel have a width, and wherein said track has a width, said track width being greater than said first and second wheel width.

7. The apparatus as defined in claim 1, wherein said motor includes a drive shaft, said drive shaft including a first end operatively connected to said motor, and a second end extending outwardly from said motor, said drive shaft including a first sprocket at said second end, said first axel including a second sprocket, said first sprocket and said second sprocket being operatively engaged by a drive chain such that when said drive shaft rotates, said first axel rotates in turn rotating said first wheel thus rotating said track such that said track drives said board across the ground surface.

8. The apparatus as defined in claim 1, wherein said frame includes disengagement means for lifting said track from engagement with the ground surface.

9. An apparatus for propelling a passenger across a ground surface, comprising:

a board including a top surface, a bottom surface, a front end and a back end, said top surface being adapted to receive the passenger thereon, and said bottom surface being adapted for sliding engagement on a ground surface;

a frame attached to said board proximate said back end, wherein said frame further includes a first side member, a second side member, an axel frame, and a spring means for biasing said axel frame in a specific direction, said first side member including a first channel therein, said second side member including a second channel therein, said axel frame including a first leg member with a first opening and a second leg member with a second opening, said first leg member being received within said first channel, said second leg member being received within said second channel such that said axel frame moves vertically within said first and second side members, said axel frame being forced in a generally downward direction by said spring means, and said first axel extending through said first and second openings of said first and second leg members of said axel frame; and a drive assembly mounted to said frame, said drive assembly including a first wheel, a second wheel, a motor and a track, said first wheel being spaced apart from said second wheel such that said track is supported by said first wheel and said second wheel, and said drive assembly further includes at least one arm member, a first axel, and a second axel, said at least one arm member including a first end with a first aperture, and a second end with a second aperture, said first axel extending through said first aperture, said first wheel being received on said first axel, said second axel extending through said second aperture, said second wheel being received on said second axel, wherein said at least one arm member is connected to said frame by a biasing means for forcing said at least one arm member in a generally downward direction such that said track engages the ground surface, said motor includes a drive shaft, said drive shaft including a first end operatively connected to said motor, and a second end extending outwardly from said motor, said drive shaft including a first sprocket at said second end, said first axel including a second sprocket, said first sprocket and said second sprocket being operatively engaged by a drive chain such that when said drive shaft rotates, said first axel rotates in turn rotating said first wheel thus rotating said track such that said track drives said board across the ground surface.

10. The apparatus of claim 9, further comprising an opening formed in said back end.

11. The apparatus of claim 9, wherein said frame is attached to said top surface.

12. The apparatus of claim 10, wherein at a portion of said track extends through said opening in said back end.

13. The apparatus of claim 9, wherein said biasing member is one or more of a spring member, a coil spring, an air spring, and an elastomeric spring.

14. The apparatus as defined in claim 9, wherein said first wheel and said second wheel have a width, and wherein said track has a width, said track width being greater than said first and second wheel width.

15. The apparatus as defined in claim 9, wherein said frame includes disengagement means for lifting said track from engagement with the ground surface.

* * * * *